US005674378A

United States Patent [19]

Kraemer et al.

[11] Patent Number: 5,674,378

[45] Date of Patent: Oct. 7, 1997

[54] DYNAMIC MIXER PROCESS WITH CONTINUOUS CAUSTIC PHASE FOR REMOVAL OF ELEMENTAL SULFUR FROM ORGANIC FLUIDS

[75] Inventors: Daniel William Kraemer, Brights Grove, Canada; Ramesh Relumal Hemrajani, Millington, N.J.

[73] Assignee: Exxon Research & Engineering Company, Florham Park, N.J.

[21] Appl. No.: 660,585

[22] Filed: Jun. 11, 1996

Related U.S. Application Data

[63] Continuation of Ser. No. 348,428, Dec. 2, 1994, abandoned.

[51] Int. Cl.[6] ..... C10G 17/00

[52] U.S. Cl. ..... 208/233; 208/208 R; 208/230; 208/232; 208/239

[58] Field of Search ..... 208/232, 233, 208/276, 237, 208 R

[56] References Cited

U.S. PATENT DOCUMENTS

| | | | |
|---|---|---|---|
| 2,460,227 | 1/1949 | Hart | 208/237 |
| 5,160,045 | 11/1992 | Falkiner et al. | 208/237 |
| 5,199,978 | 4/1993 | Porier et al. | 208/233 |
| 5,250,181 | 10/1993 | Falkinev et al. | 208/237 |

*Primary Examiner*—Helane Myers
*Attorney, Agent, or Firm*—Joseph J. Allocca

[57] ABSTRACT

The present invention is directed to a process for the removal of elemental sulfur from fluids such as fuels, e.g. gasoline, kerosene, diesel or jet, by contacting said fluids with an immiscible treatment solution comprising water or immiscible alcohol, caustic, sulfide or hydrosulfide and optionally mercaptan, in a staged co-current mixer under conditions such that the immiscible treatment solution constitutes the continuous phase.

6 Claims, No Drawings

DYNAMIC MIXER PROCESS WITH CONTINUOUS CAUSTIC PHASE FOR REMOVAL OF ELEMENTAL SULFUR FROM ORGANIC FLUIDS

This is a continuation, of application Ser. No. 348,428, filed Dec. 2, 1994, now abandoned.

BACKGROUND OF THE INVENTION

1. Field of the Invention

The present invention relates to a process for removing elemental sulfur from fluids such as fuels, e.g. gasoline, diesel, kerosene, jet, by contacting such fluids with an immiscible treatment solution comprising water or immiscible alcohol solution, caustic sulfide or hydrosulfide and optionally a mercaptan, whereby the elemental sulfur is converted into a polysulfide which is not soluble in the treated fluid but is soluble in the immiscible treatment solution thus producing a fluid product of low elemental sulfur content.

2. Description of the Related Art

It is well known that elemental sulfur and other sulfur compounds contained in hydrocarbon streams are corrosive and damaging to metal equipment, particularly copper and copper alloys. Sulfur and sulfur compounds may be present in varying concentrations in the refined fuels and additional contamination may occur as a consequence of transporting the refined fuel through pipelines containing sulfur contaminants present therein as a consequence of the transportation of sour hydrocarbon streams such as petroleum crudes in the pipeline. Sulfur has a particularly corrosive effect on equipment such as brass valves, gauges and in-tank fuel pump copper commutators.

Various techniques have been reported for removing elemental sulfur from petroleum products. For example U.S. Pat. No. 4,149,966 discloses a method for removing elemental sulfur from refined hydrocarbon fuels by adding an organo-mercaptan compound and a copper compound capable of forming a soluble complex with said mercaptan and said sulfur and contacting said fuel with an adsorbent material to remove the resulting copper complex and substantially all the elemental sulfur.

U.S. Pat. No. 4,908,122 discloses a process for sweetening a sour hydrocarbon fraction containing mercaptans by contacting the hydrocarbon fraction in the presence of an oxidizing agent with a catalytic composite, ammonium hydroxide and a quaternary ammonium salt other than hydroxide.

U.S. Pat. No. 3,185,641 describes a method for removing elemental sulfur from a liquid hydrocarbon which comprises contacting with solid sodium hydroxide a hydrocarbon stream having dissolved therein at least 7.6 parts by weight of water per part of sulfur contained therein to yield both a hydrocarbon phase and an aqueous phase. The method is claimed to be effective and convenient for treating gasoline containing from trace to more than 25 ppm sulfur employing temperatures as high as about 140° F. (60° C.).

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

U.S. Pat. No. 5,160,045 discloses a process for removing elemental sulfur from fluids such as gasoline, diesel fuel, jet fuel or octane enhancement additives such as ethers (MTBE) which pick up sulfur when transported through pipelines which are otherwise used for the transport of some hydrocarbon streams. In that patent the sulfur containing fluid is contacted with an aqueous solution containing caustic, sulfide and optionally elemental sulfur to produce an aqueous layer containing metal polysulfides and a clear fluid layer having a reduced elemental sulfur level. Preferably an organo mercaptan is also mixed with the fluid to accelerate the removal of elemental sulfur. This patent also recites that alcohols such as methanol, ethanol, propanol, ethylene glycol, propylene glycol, etc. may be added to the aqueous caustic mixture which is contacted with the fluid to be treated. The amount of alcohol used may vary within wide limits. In the case of methanol the patent recites that from 0 to about 90 volume percent of the water may be replaced with alcohol.

U.S. Pat. No. 5,199,978 discloses a process for removing elemental sulfur from fluids such as gasoline, diesel fuel, jet fuel or octane enhancement additives such as ethers (MTBE) which pick up sulfur when transported through pipelines which are otherwise used for the transport of sour hydrocarbon streams. In that patent the sulfur containing fluids are mixed with an inorganic caustic material, an alkyl alcohol and an organo mercaptan or inorganic sulfide compound capable of reacting with sulfur to form a fluid insoluble polysulfide salt reaction product at ambient reaction temperatures. The treated fluid is then contacted with an adsorbent or filtered to remove the insoluble salt leaving a fluid product of very low residual sulfur content.

U.S. Pat. No. 4,248,695 is directed to a process for desulfurizing a sulfur containing fuel comprising contacting the fuel with a lower primary alkanol solution containing an alkali metal hydrosulfide at a temperature and pressure from ambient up to the critical temperature of the alkanol solvent, the water content of said solution being below that which will cause said hydrosulfide to decompose into $K_2S$ hydroxide, and separating said fuel from said alkanol solution now containing the corresponding high sulfur content alkali metal polysulfide with the proviso that the volume ratio of said alkanol solution to said fuel is determined by the gram mols of sulfur present in the fuel divided by 1½ gram mole of sulfur, when sodium is the alkali metal, times the molecular weight of sodium hydrosulfide divided by the number of grams of sodium hydrosulfide per milliliter of the alkanol solution and the volume ratio of said alkanol solution to said fuel is determined by the gram mols of sulfur present in the fuel divided by 2 gram mols of sulfur, when potassium is the alkali metal, times the molecular weight of potassium hydrosulfide per milliliter of the alkanol solution. The process can further include the step of adding 10% water to said separated alkanol solution when its alcohol is below boiling temperatures to separate the alcohol and the polysulfide from the fuel. As an additional step water in an amount of not more than one half of the volume of the alkanol can be added to dissolve the alkali metal polysulfide to form a concentrated solution in water which separates from the fuel.

DESCRIPTION OF THE INVENTION

The present process is directed to the removal of elemental sulfur from organic fluids such as hydrocarbon fuels (e.g. gasoline, kerosene, diesel, jet), fuel blending components such as octane improvers (ethers such as MTBE), mixtures thereof, liquefied petroleum gas (LPG), solvents, and other petroleum streams transported in pipelines which are otherwise used for the transportation of sour hydrocarbon streams such as crude oil, said process comprising intimately contacting the sulfur containing fluid with an immiscible treating solution comprising water or immiscible alcohol solution, i.e. an alcohol, mixture of alcohols or mixture of alcohol and water which is immiscible in the fluid to be treated, caustic, and sulfide or hydrosulfide to form a mixture in a mixer wherein the immiscible treating solution constitutes the continuous phase of the mixture, mixing the sulfur containing fluid and the treating solution for a time sufficient to convert the elemental sulfur into a polysulfide which is insoluble in the treated fluid but is soluble in and dissolves in the immiscible treating solution, passing the mixture to a liquid/liquid separation zone such as a settling tank wherein the mixture separates into two phases wherein, depending on the difference in the density of the treated fluid as compared to the immiscible treating solution, the treated fluid forms either the top phase or the bottom phase, drawing off the treated fluid phase to thereby recover a fluid of reduced elemental sulfur content and drawing off the immiscible treatment solution phase containing polysulfides dissolved therein. Optionally an organic mercaptan can also be employed in which case the organic mercaptan is added to the sulfur containing fluid before the fluid is contacted with the immiscible treating solution comprising water or immiscible alcohol, caustic and sulfide or poly sulfide. When the immiscible treating solution is spent, i.e., is incapable of converting any additional elemental sulfur into polysulfides, it can be withdrawn from the process and subjected to a separation step such as flash distillation to recover recoverable components such as alcohol which can be recycled, or a portion can be so withdrawn while fresh solution is added to the remainder to revitalize it to same preset sulfur capacity limit. If the treating solution is not completely spent, all or a portion of the immiscible treating solution can be recycled to the process as such or with a quantity of make up immiscible treating solution being added to maintain the volume and sulfur capacity of the solution within some preset limits.

In practicing the process a mixing zone is employed which is preferably a multistage mixing zone which contains at least two mixing stages, preferably at least 3 mixing stages, more preferably at least 4 mixing stages, most preferably 5 or more mixing stages. Preferably the multistage mixer is a co-current mixer. Each stage contains single or multiple agitation means such as impellers, paddles, propeller blades, perforated impellers, wire wisk wands, etc. to effect the required mixing. The multi-stage mixing zone can contain multiple single stage mixers arranged in series, or it can constitute a single vessel housing multiple stages or it can constitute a single stage unit operating in a recirculating batch mode wherein the charge to be treated is mixed and recirculated either continuously or in plug flow mode, through the unit a number of times following which the treated batch is sent to the liquid/liquid separation zone for phase separation.

When using a multi stage unit in a continuous flow mode the stages are separated by baffles between stages. The baffles can have an open area for flow between the zones of 1 to 15% of the total cross sectional area of the unit in the plane of the baffle. Preferably the open area between zones (i.e., open area of the baffle) is 1 to 5%. The baffles are preferably in fluid tight attachment to the interior of the vessel wall with the baffle open area being situated elsewhere on the baffle other than at the edge, preferably situated approximately in the center area of the baffle thus forcing the liquid through the open area and inducing additional mixing.

The mixer is run at speeds sufficient, depending on the configuration of the agitation means employed, to produce mixing energy per thousand gallons of mixture being mixed of from 0.1 to 200 hp/kgal, preferably mixing energy of about 1 to 15 hp/kgal of mixture being mixed.

In the process it unexpectedly has been found that superior results are obtained in terms of level of elemental sulfur removed and physical condition of the fluid treated (e.g. clear or hazy and degree of caustic entrainment) when the immiscible caustic treating solution is the continuous phase of the mixture.

To establish the elemental sulfur containing fluid in the dispersed phase and the immiscible caustic treating solution in the continuous phase a specific mixer start-up procedure must be followed. The immiscible caustic treating solution must be introduced into the mixer first. Thus the mixer can be first filled with immiscible caustic treating solution, with the agitators either on or off, preferably off, then the agitator can be started and the elemental sulfur containing fluid to be treated can be added. The phase initially surrounding the agitator at rest will be the continuous phase after the agitator is started and the second solution is added (be it the caustic or the sulfur containing fluid). This condition of caustic being the continuous phase, if added to the mixer first, will be maintained even as additional volumes of sulfur containing fluid to be treated and fresh or recycle immiscible caustic treating solution are added to the mixer and even as the ratios of the two change, the immiscible caustic treating solution remaining the continuous phase even at a treat level as low as 5% (provided relatively fresh caustic solution is being used, as explained in greater detail below).

As the caustic becomes used with time on stream by being consumed in converting elemental sulfur to sodium polysulfides, the minimum treat rate required to maintain the sulfur containing fluid as the dispersed phase increases. The relationship between the capacity factor of the caustic treating solution (the vol. of sulfur containing fluid which has actually been processed per volume of caustic inventory) and minimum treat rate needed to maintain the sulfur containing fluid as the dispersed phase and the caustic phase as the continuous phase has been determined and is presented below:

| Capacity Factor | Minimum Treat Rate for Sulfur Containing Fluid as Dispersed Phase |
|---|---|
| 250 | 10% |
| 500 | 43% |
| 750 | 48% |

Thus, for example, for a process designed for a capacity factor of 500, that is, for a process designed to run under conditions such that the caustic solution will be or will have been exposed to up to 500 volumes of sulfur containing fluid per volume of caustic inventory present before being either replaced or provided with quantities of fresh make-up caustic to increase the caustic inventory available for reaction with the sulfur on the sulfur containing fluid, the minimum treat rate is set at about 43–45% (caustic to sulfur containing fluid). Capacity factor refers to the life history of the caustic solution and is a measure of how many volumes of sulfur containing feed have in fact been treated per volume of caustic inventory. A high capacity factor indicates that a large volume of feed has been processed per volume of caustic, thus meaning that there is less caustic left available for further feed treatment.

Therefore, the process of the present invention can be run in a caustic continuous phase mode at treat rates in the range of 5 to 200%, preferably 5 to 100% more preferably 50 to 100% depending on just how spent the caustic is. The more spent the caustic (higher capacity factor) the higher the treat rate needed to insure that the caustic phase is the continuous phase.

The fluids which are treated in accordance with the invention include fluids containing elemental sulfur in which the presence of elemental sulfur is detrimental to the performance of the fluid. The invention is particularly applicable to those liquid products which have become contaminated with elemental sulfur as a result of being transported in a pipeline previously used to transport sour hydrocarbon streams such as petroleum crudes.

The fluids treated in accordance with the invention include a wide variety of petroleum fuels and particularly refined hydrocarbon fuels such as gasoline, jet fuel, diesel fuel and kerosene.

Other fluids include ethers used to improve the octane ratings of gasoline. these ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, isopropyl tertiary-amyl ether. Mixtures of these ethers and hydrocarbons may also be treated in accordance with the invention.

The organic mercaptans useful in the present invention include a wide variety of compounds having the general formula RSH, where R represents an organic radical which may be alkyl, alkenyl, cycloalkyl, cycloalkenyl, aryl of arylalkyl having from 1 to about 16 carbon atoms. Thus, the radical may be, for example methyl, ethyl, n-propyl, i-propyl, n-butyl, i-butyl, sec-butyl, t-butyl, amyl, n-octyl, decyl, dodecyl, octadecyl, phenyl, benzy) and the like. Most preferably, RSH is an alkyl mercaptan containing 2 to 5 carbon atoms.

In another embodiment of the invention, the mercaptan may be combined with or replaced by a sulfide such as $K_2S$, $Na_2S$, NaHS, $Li_2S$, $H_2S$ and the like.

The inorganic caustic material which is employed in this invention includes alkali metal or ammonium hydroxides having the formula MOH wherein M is selected from the group consisting of lithium, sodium, potassium, $NH_4$ or mixtures thereof. M is most preferably sodium or potassium. As a result of the use of the inorganic caustic material, the resultant sulfur products are insoluble in the treated fluids but are soluble in the treating solution. Any unsoluble sulfides which remain entrained in the treated fluids may be removed by the use of adsorbents and/or filtration.

The sulfide in caustic reacts with the elemental sulfur in the fluid to be treated to form polysulfides in caustic. Elemental sulfur as such may be added to the caustic treating solution for promoting the reaction or it may be already present in caustic such as is obtained as white liquor from paper pulp mills.

The caustic sulfide or hydrosulfide, and optionally sulfur, are introduced to the sulfur containing fluid in the form of an immiscible treating fluid. The immiscible treating fluid is formed either by combining the caustic, sulfide or hydrosulfide and optionally sulfur in water or in an immiscible alcohol solution such as methanol or a $C_1$ to $C_5$ alcohol or polyol (e.g. methanol, ethanol, propanol, iso-propanol, butanol, iso or tert-butanol, pentanol, iso or tert pentanol, ethylene glycol, propylene glycol, polyglycols, glycol ethers) containing water. If the optional organic mercaptan is also employed it is combined with the sulfur containing fluid (hydrocarbon) before the addition of the caustic sulfide to the sulfur containing hydrocarbon fluid. It is preferred that if the immiscible solvent is an immiscible aqueous alcohol solution that the alcohol contain between 1 to 5% water, as taught in copending application, Attorney Docket Number LAW153 U.S. Ser. No. 348,512 now U.S. Pat. No. 5,525,233 filed even date herewith in the names of Poirier, Falkiner and Kraemer. In that application in which the treatment was run in a caustic dispersed/gasoline continuous phase mode it is shown that the best sulfur removal performance in combination with the best product physical characteristics (e.g. no haze or caustic entrainment) are achieved when, when using aqueous alcohol, the alcohol contains 1 to 5% water and the treat rate of caustic solution to feed to be treated is about 0.6 to less than 30% (treat levels at which the caustic is not necessarily the continuous phase). To use an immiscible aqueous alcohol caustic treating solution in the present invention in which the caustic solution is the continuous phase the treat rate used is the range previously recited herein, i.e. 5 to 200%.

Fluids containing quantities of elemental sulfur as high as 100 mg. or higher, sulfur per liter, more usually from about 10 to about 60 mg per liter, can be effectively treated in accordance with this invention to reduce the sulfur contamination to about 5 mg sulfur per liter or lower.

In general, the process of the invention involves the addition of the sulfur containing fluid to be treated to an effective amount of caustic, water, sulfide, and optionally elemental sulfur and/or immiscible alcohol. If the organo mercaptan is used it is added separately to the sulfur containing fluid to be treated before addition to the caustic solution. The mixture is mixed in the multi-stage agitated mixer with the immiscible caustic treating solution being the continuous phase. It is then allowed to settle so as to form an aqueous layer containing metal polysulfides and a clear fluid layer having a reduced elemental sulfur level. Contact with the mercaptan would result in a clear fluid layer having a reduced elemental sulfur level and containing soluble polysulfide reaction products which are relatively noncorrosive. The treated fluid may be recovered by decantation. The treated fluid is drawn off from the settler and passed through a sand filter and then subjected to a water wash to produce a clear fluid product having a caustic (NaOH) content of less than 0.3 mg/l. The recovered immiscible caustic layer may be recycled back to the mixing zone for contact with the fluid to be treated or it may be discarded or used, for example, as a feedstock to sulfide pulping paper mills.

The treating conditions which may be used to carry out the present invention are conventional and recited in detail in U.S. Pat. No. 5,160,045 and U.S. Pat. No. 5,199,978. Contacting of the fluid to be treated is effected at ambient temperature conditions, although higher temperatures up to 100° C. or higher may be employed. Substantially atmospheric pressure is suitable, although pressures may, for example, range up to 1,000 psig. Contact times may vary widely depending on the fluid to be treated, the amount of elemental sulfur present therein and the treating materials used. The contact time will be chosen to effect the desired degree of elemental sulfur conversion. The reaction proceeds relatively fast, usually within several minutes, depending on solution strengths and compositions. Contact times from 30 seconds to a few hours may be employed.

Typically, the immiscible caustic treating solution contains caustic in the range of 0.01 to 20M, the sulfide concentration is from 0.1 to 20M and the elemental sulfur concentration is from 0 to 10% by weight. The amount of organo mercaptan which may be optionally added may range from 0 to about 3 moles of organo mercaptan per mole of elemental sulfur present in the fluid to be treated. The relative amount of treating solution and the fluid to be treated may also vary within wide limits. Treat rates of about 5 to 200%, preferably about 5 to 100%, more preferably about 50 to 100% caustic solution to sulfur containing fluid are employed.

In accordance with the present invention it has been found that which phase is the dispersed phase in the mixer and the capacity factor of the caustic (volume of fluid processed per volume of caustic inventory, i.e. a measure of caustic time-on-stream) can have a significant impact on the elemental sulfur removal rate. With the caustic phase as the dispersed phase, the percentage of elemental sulfur removal is significantly less than when the caustic phase is the continuous phase for the same volume percent of caustic hold up and reaction time. The amount of entrained caustic solution after settling is much less when the caustic is the continuous phase.

The invention is further illustrated in the following non-limiting examples.

EXAMPLE 1

A 4 inch diameter by 16 inch high dynamic mixer was used to contact fresh 20° Bé caustic (166 g NaOH per liter of water) with gasoline containing 50 mgl of elemental sulfur. To the gasoline was added 150 mg/l of propyl mercaptan ($P_rSH$) before entering the bottom of the mixer. The conditions used were 20 minutes residence time, 3° C., 390 RPM (2 hp/kgal) and 30% treat rate of caustic (30 vol caustic/100 vol gasoline). The mixer was first operated such that the caustic phase was dispersed in the gasoline. After a steady state condition was achieved, the elemental sulfur level in the gasoline at the outlet of the mixer was measured to be 7 mg/l and the volume percent of caustic in the mixer was 53%. The same experiment was repeated with the exception of gasoline being the dispersed phase. In that case the mixer was first loaded with the caustic solution then the mixer was turned on and the gasoline added to the mixer. The resulting elemental sulfur level in the gasoline at the mixer outlet was measured to be 1 mg/l and the volume percent of caustic in the mixer was 33%. Also, samples taken at the mixer outlet were allowed to settle and it was found that less entrained NaOH was present in the gasoline for the gasoline dispersed case versus the caustic dispersed case (4.3 vs. 10.1 mg NaOH per L gasoline respectively after 8 minutes settling time).

EXAMPLE 2

The same operating conditions as Example 1 were used with the exception of impeller speed being 670 rpm (10.1 hp/kgal). A "used" caustic solution with a capacity factor of approximately 500 (vol. gasoline processed/vol caustic inventory) was employed as the treating solution. The following results were obtained:

| | Caustic Dispersed | vs. | Gasoline Dispersed |
|---|---|---|---|
| Product elemental sulfur, mg/l: | 26 | | 2 |
| mg NaOH/L after 8 min settling: | 8.0 | | 0.4 |
| Volume percent caustic in mixer: | 29% | | 28% |

It is apparent that, all conditions being otherwise equal, unexpectedly superior results are obtained when the gasoline is the dispersed phase (i.e. caustic is the continuous phase).

What is claimed is:

1. A method for removing elemental sulfur from organic fluids comprising contacting the elemental sulfur containing organic fluids with an immiscible treating solution comprising water or immiscible alcohol solution, caustic and sulfide or hydrosulfide to form a mixture in a mixer wherein the immiscible treating solution constitutes the continuous phase of the mixture and the elemental sulfur containing organic fluid constitutes the dispersed phase of the mixture, and wherein the elemental sulfur containing organic fluid has added to it an organic mercaptan prior to the elemental sulfur containing organic fluid being mixed in with the immiscible treating solution, mixing the elemental sulfur containing fluid and the immiscible treating solution for a time sufficient to convert the elemental sulfur into a polysulfide which is insoluble in the organic fluid but is soluble in and dissolves in the immiscible treating solution, passing the mixture to a liquid/liquid separation zone wherein the mixture separates into two phases, drawing off the treated organic fluid to recover an organic fluid of reduced elemental sulfur containing and drawing off the immiscible treating solution phase containing polysulfides, wherein the organic mercaptan is a $C_1$–$C_{16}$ alkyl, alkenyl, cycloalkyl or cycloalkenyl mercaptan.

2. The method of claim 1 wherein the mixer is a multi stage mixer.

3. The method of claim 1 wherein the mixer is a co-current mixer.

4. The method of claim 1 wherein the mixer is operated at speeds sufficient to produce mixing energy per thousand gallons of mixture being mixed of from 0.1 to 200 lq/kgal.

5. The method of claim 1 wherein the immiscible treating solution is added to the mixer before the sulfur containing fluid.

6. The method of claim 1 wherein the immiscible treating solution is used at a treat rate of 5 to 200%.

* * * * *